United States Patent [19]

Michlovic

[11] Patent Number: 4,835,927

[45] Date of Patent: Jun. 6, 1989

[54] PREFABRICATED GLAZING GASKET

[75] Inventor: John J. Michlovic, Avon Lake, Ohio

[73] Assignee: The Standard Products Company, Cleveland, Ohio

[21] Appl. No.: 16,751

[22] Filed: Feb. 19, 1987

[51] Int. Cl.[4] ..... E06B 1/68

[52] U.S. Cl. ..... 52/400; 52/208; 52/213; 52/403; 52/825

[58] Field of Search ..... 52/208, 397–403, 52/202, 203, 171, 172, 213, 215, 211, 488, 489, 468, 815, 821, 823, 825, 826

[56] References Cited

U.S. PATENT DOCUMENTS

| | | | |
|---|---|---|---|
| 2,257,035 | 9/1941 | Chaffee | 52/208 |
| 2,303,149 | 11/1942 | Verhagen | 52/399 |
| 2,548,556 | 4/1951 | Ogren | 52/400 |
| 3,213,584 | 10/1965 | Bush | 52/400 |
| 3,680,276 | 8/1972 | Wright et al. | 52/400 X |
| 3,698,148 | 10/1972 | Marantier | 52/400 |
| 3,707,816 | 1/1973 | Van Wuyckuyse | 52/213 |
| 3,931,699 | 1/1976 | Sarvay | 52/403 X |

FOREIGN PATENT DOCUMENTS

| | | | |
|---|---|---|---|
| 889069 | 12/1971 | Canada | 52/400 |

*Primary Examiner*—David A. Scherbel
*Assistant Examiner*—Richard E. Chilcot, Jr.
*Attorney, Agent, or Firm*—Harness, Dickey & Pierce

[57] ABSTRACT

A glazing system with an elastomeric glazing gasket, preferably of the lockstrip type, which has sealing wings and is prefabricated to continuously extend around the perimeter of a window opening. The system also includes means for mounting the gasket with the sealing wings in contact with the perimeter of the window opening.

23 Claims, 3 Drawing Sheets

PREFABRICATED GLAZING GASKET

BACKGROUND OF THE INVENTION

The present invention relates to window glazing systems. More particularly, the present invention relates to a prefabricated window glazing gasket system which extends continuously around the perimeter of a window opening and serves both framing and sealing functions.

Conventionally, in a fixed lite window, glass or other flat panels are glazed into a metal or wood frame. Sealing against the entry of water and air is provided by a glazing compound or caulk, or by a preformed elastomeric gasket on each side of the glass or panel. Additionally, the perimeter of the window frame is caulked both inside and outside where the frame abuts the perimeter construction.

One useful glazing system utilizes elastomeric lockstrip or zipper gaskets mounted on metal frames. Sealing against the glass is provided by gasket lips against the locking strip. Sealing at the perimeter construction is provided, again, by a field applied caulking at the base of the frame on both the interior and exterior points of contact.

Another useful glazing system utilizes elastomeric lockstrip or zipper gaskets mounted in a reglet or receiver cast into the concrete perimeter of single or punched windows. While this system eliminates the need for an expensive jobsite fabricated window frame and the inherent wet sealants, its usefulness is limited because the reglet or receiver must be precast in the concrete perimeter of the window opening.

Lockstrip glazing systems of syntheric rubber offer certain advantages over other systems. For example, synthetic rubber requires almost no maintenance and yet is long lasting. Synthetic rubber also provides a thermal break to give better temperature insulation characteristics to the window system. Furthermore, synthetic rubber will dampen vibration and insulate the building interior from outside noise. Thus, it would be desirable to provide these benefits economically in buildings with fixed glazing in punched openings without precast reglets or receivers.

It would also be desirable to provide a glazing system which is easily installed. At the present time, most glazing systems involve relatively complex frames which must be field fabricated at the job site to the exact size of each window opening in a labor intensive procedure. Each window must be measured separately and numerous metal or wood parts must be individually cut and installed around the window perimeter to provide a window frame. The window pane is then set in place in the frame, glazing stops are installed, and then the window perimeter must be sealed, for example, by caulking on both interior and exterior sides. Caulking is a labor intensive procedure which is often imperfectly done leading to leakage.

In accordance with the window glazing system of the present invention, an elongated elastomeric gasket is prefabricated so that it can be easily installed at the job site on any type of window perimeter such as concrete, metal, wood, block, etc. The gasket provides both the window frame and the window seal so that the complex field fabricated frames of conventional window glazing systems are not necessary. The resulting glazing system has the advantages of vibration damping, zero maintenance, thermal break, and sound isolation. Furthermore, the amount of labor required for installation is substantially less than that required for a conventional window glazing system. These and other advantages will be apparent from the following disclosure taken in conjunction with the accompanying drawings.

SUMMARY OF THE INVENTION

In accordance with the present invention, a glazing system comprises an elastomeric glazing gasket prefabricated to continuously extend around the perimeter of a window opening and means for mounting the gasket in sealing relationship against the perimeter of the window opening. The prefabricated glazing gasket has a glass-receiving channel facing toward the interior of the perimeter and sealing wings facing and contacting the exterior of the perimeter. When the glazing gasket and glass are in place, the perimeter edges of the glass extend into, and are sealed in, the glass-receiving channel. The sealing wings carry sealing ribs to enhance the seal against the window perimeter.

DESCRIPTION OF THE INVENTION

Figure 1:
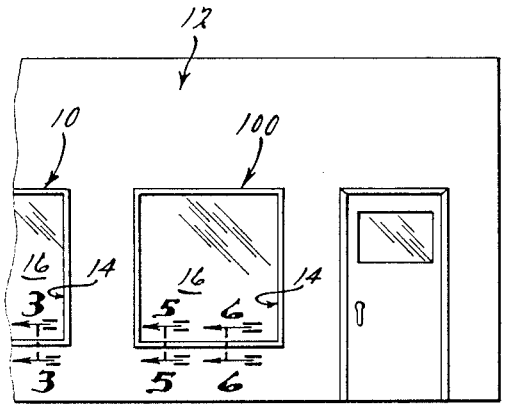
FIG. 1 is a side elevation of a typical building with multiple spaced-apart windows incorporating a glazing system of the present invention.

Now referring to the figures, FIG. 1 illustrates a typical building 12 with two spaced-apart windows one of which is framed and sealed by an embodiment of the glazing system of the present invention indicated generally by the numeral 10 and the other framed and sealed by an alternative embodiment of the present invention indicated generally by the numeral 100. Building 12 is characterized by having "punched out" window openings 14 and can be either a new construction or a previously built structure requiring new windows. Although shown as concrete, the window perimeter can consist of any building material.

Figure 2:
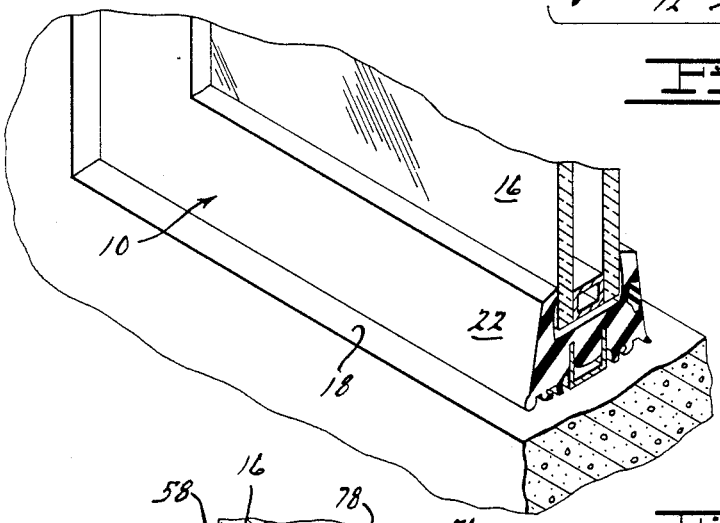
FIG. 2 is a perspective view, partially in section and broken away, of a preferred glazing system of the present invention installed in a concrete window opening with an insulated glass lite.
Figure 3:
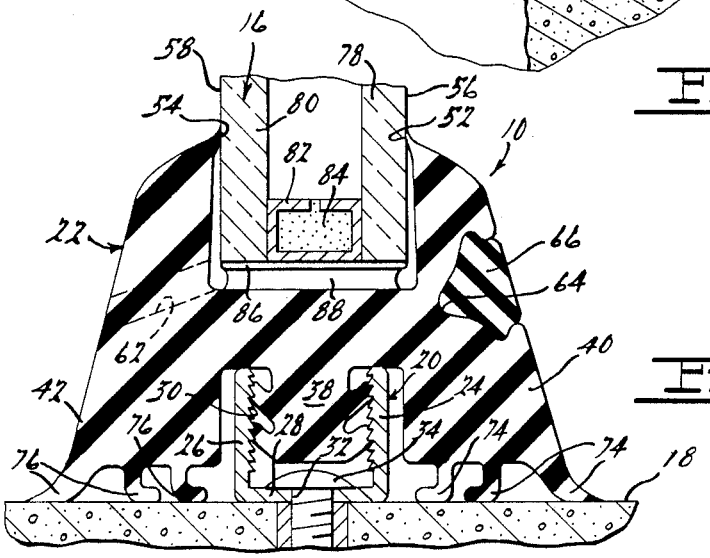
FIG. 3 is a sectional view, broken away, taken along line 3—3 in FIG. 1.

Glazing system 10 extends continuously around the perimeter of the associated window opening 14 in sealing relationship between an associated glass pane or lite 16 and the inwardly facing surface 18 of window opening 14. As is best illustrated in FIGS. 2 and 3, glazing system 10 has a receiver 20 and glazing gasket 22.

Receiver 20 extends around the perimeter of window opening 14 and is generally U-shaped in cross-section with two legs, 24 and 26 joined by web 28. Each leg 24 and 26 has longitudinally extending serrations 30 for retention of gasket 22 as set forth in more detail hereinafter. Web 28 has a plurality of apertures 32 through which fasteners such as screws 34 extend to attach receiver 20 to the surface 18 of window opening 14. Apertures 32 will, of course, generally be drilled during installation. Receiver 20 is preferably made of aluminum or other suitable material.

Figure 4:
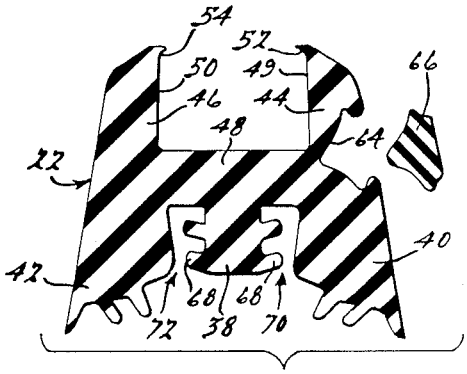
FIG. 4 is a sectional view somewhat similar to FIG. 3 but showing the glazing gasket of FIGS. 2 and 3 before installation.

Glazing gasket 22 is preferably made of an elastomeric material such as Neoprene® or another synthetic rubber and coextends with receiver 20 continuously around the entire perimeter of window opening 14. As is best shown in FIGS. 2–4, glazing gasket 22 has a window-receiving channel 36 open towards the interior of window opening 14, a longitudinal mounting spline 38 adapted to fit tightly into channel 20 and inner and outer sealing wings 40 and 42 which seal gasket 22 with respect to surface 18 of window opening 14.

Window-receiving channel 36 is defined by interior side wall 44 and exterior side wall 46 and web portion 48 of gasket 22. Side walls 44 and 46 have inwardly curving surfaces 49 and 50 respectively, which are preferably concave as shown best in FIG. 3, with surface portions 52 and 54 sealably contacting opposing surfaces 56 and 58 of lite 16. Exterior side wall 46 has a plurality of drain passageways 62 which extend in fluid communication between channel 36 and the exterior environment and are oriented to provide gravity drainage of any fluid leaking into channel 36. Side wall 44 has a longitudinal groove 64 which accommodates locking strip 66. Locking strip 66 applies compressive force against lite 16 to substantially seal against water and air penetration along surfaces 54 and 52. It will, of course, be appreciated that, alternatively, longitudinal groove 64 and locking strip 66 can be located in the exterior wall 46.

Mounting spline 38 has lugs 68 which engage longitudinal serrations 30 of receiver 20 when spline 38 is forced into receiver 20 a distance sufficient to provide secure retention therein but allowing space for headed fasteners 34. Grooves 70 and 72, in gasket 22 freely receive legs 24 and 26 of receiver 20. Inner sealing wing 40 has a plurality of longitudinally extending sealing ribs 74 which are held in compression against surface 18 by means of mounting spline 38 in receiver 20. Outer sealing wing 42 has analogous sealing ribs 76. Thus mounting spline 38 cooperates with receiver 20 and headed fasteners 34 to provide means for mounting gasket 22 about the perimeter of window opening 14 with sealing ribs 74 and 76 in sealing relationship against surface 18 of window opening 14.

Lite 16 is conventional in construction and comprises a pair of panes 78 and 80 and a spacer 82 which encloses a dessicant 84. A sealant 86 extends around the perimeter edge of lite 16. Lite 16 rests on setting block 88 as is conventional in the art. Lite 16 is illustrated as a pane of glass but could alternately be a panel comprised of mastic wood, metal, fiber glass, etc.

In use, it is contemplated that glazing gasket 22 will be prefabricated at a manufacturing facility. This can be done, for example, by conventionally extruding appropriate lengths of gasket 22 and then joining the lengths at the corners in an injection molding process. The fabricator adds an additional 1 to 2% extra length in each longitudinal direction so that the finished gasket 22 will be slightly larger than the window opening and will be crowded into position along the longitudinal axis of each segment when installed. The longitudinal compressive forces resulting at the four corners of the gasket 22 assure proper sealing in the corners and allow the opening dimensions of window 14 to be inexact to some degree while maintaining the proper sealing function of the gasket system. Since the elastomeric materials commonly used will compress, the gasket can be made slightly oversized and will compress to fit the opening 14.

Once gasket 22 is prefabricated, it can be shipped to the job site for installation. Installation is carried out by cutting lengths of receivers 20 to the appropriate length and securing them about the perimeter of the window opening 14. Then gasket 22 is installed by forcing spline 38 into receiver 22 about the window perimeter. The spline 38 should be forced sufficiently far into the receiver 20 so as to ensure compression and sealing contact between the sealing ribs 74 and 76 and the window opening perimeter surface 18. Legs 24 and 26 provide gauge means in that the heights of legs 24 and 26 are preferably sized to ensure proper sealing when gasket 22 abuts against the top edges of legs 24 and 26. On rough or uneven surfaces 18 it may be preferable to caulk ribs 74 and 76 or to bed receiver 20 in caulking or a setting base material to ensure a good seal against the weather elements. Finally, the lite 16 is set in place by bending the inner side wall 44 downwardly, installing lite 16 and inserting lockstrip 66.

Figure 5:
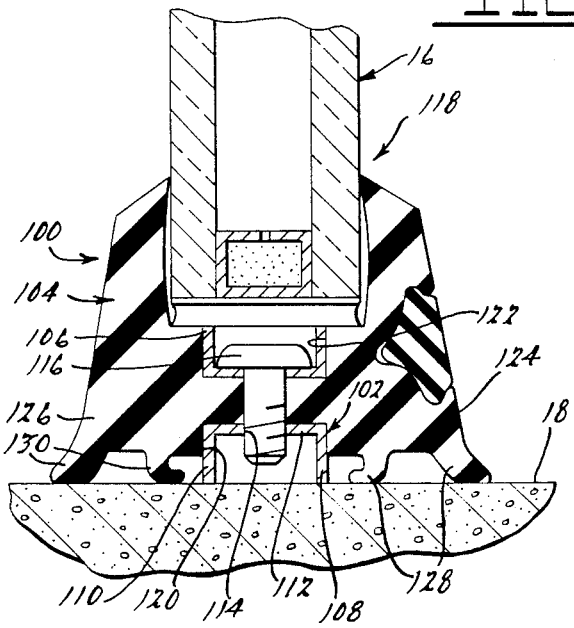
FIG. 5 is a sectional view, broken away, taken along line 5—5 in FIG. 1 and illustrating an alternative embodiment of the present invention.
Figure 6:
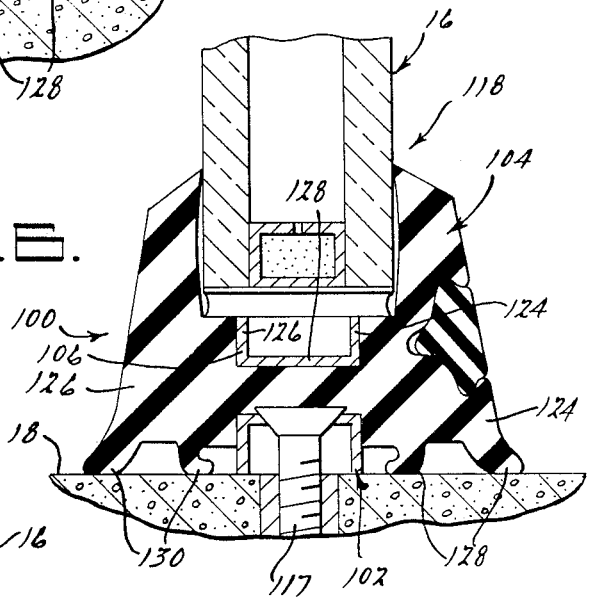
FIG. 6 is a sectional view, broken away, of the embodiment of FIG. 5 taken along line 6—6 in FIG. 1.

An alternative embodiment of the present invention is illustrated in FIGS. 1, 5 and 6 and indicated generally by the numeral 100. Glazing system 100 also extends continuously around the perimeter of associated window opening 14 in sealing relationship between associated gasket 104 and the inwardly facing surface 18 of window opening 14. Glazing system 100 is similar to glazing system 10 and comprises modified receiver 102 and gasket 104 but has an internal load distributing channel shaped member 106 for spreading fastener load forces evenly along the longitudinal length of gasket 104.

Thus, receiver 102 is U-shaped in cross-section with legs 108 and 110 and web portion 112 but with the opening of the channel facing outwardly with respect to the perimeter of window opening 14. Web portion 112 has a plurality of apertures 114 which receive fastening elements 116 for retention of gasket 104. Receiver 102 is preferably made of steel or aluminum.

Glazing gasket 104 is made of an elastomeric material preferably synthetic rubber such as Neoprene® and coextends with receiver 102 around the perimeter of window opening 14. Glazing gasket 104 has a lite-receiving channel 118 opens towards the interior of window opening 14, and inner and outer sealing wings 124 and 126 which are analogous to the corresponding elements of glazing gasket 22.

Means for mounting glazing gasket 104 includes mounting channel 120 sized to receive a portion of receiver 102, and channel 122 sized to receive load transfer or distributing member 106. Load distributing member 106 is channel shaped in cross-section with legs 124 and 126 and web 128 with apertures through which extend fastening elements 116. Fastening elements attach load distributing member 106 to receiver 102 which is itself attached to the perimeter of window opening 14 by fasteners 117. Load distributing member 106 thus allows fastening elements 116 to tightly secure member 106 to receiver 102 to place sealing ribs 128 and 130 in sealing compression against surface 18 without distorting the shape of lite-receiving channel 118.

It is contemplated that glazing gasket 104 will be prefabricated at a manufacturing facility as was gasket 22. Installation of glazing gasket 104 can be carried out by cutting lengths of receivers 102 to the appropriate length and securing them about the perimeter of the window opening by means of fastening elements 117 as illustrated in FIG. 6. Then gasket 104 can be installed by placing channel 120 over receiver 102 about the window perimeter and securing with fastening elements 116 as shown in FIG. 5. Fastening elements 116 are tightened sufficiently to ensure compression and sealing contact between the sealing ribs 128, 130 and the window opening perimeter surface 18. Finally, the lite 16 is set in place as in the previously disclosed embodiment.

Figure 7:
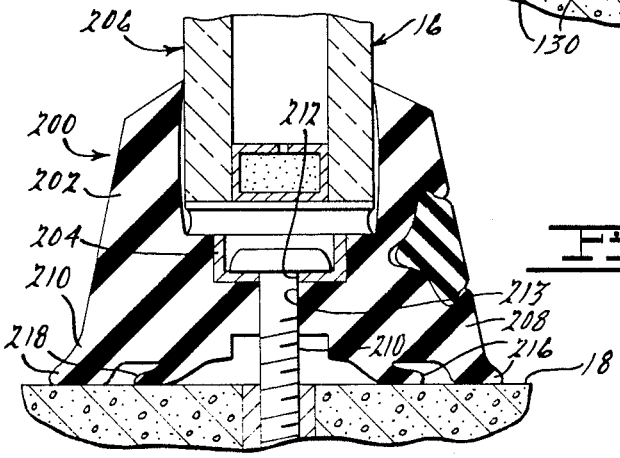
FIG. 7 is a sectional view, broken away, analogous to FIG. 3, but illustrating another alternative embodiment of the present invention.

Now referring to FIG. 7, yet another preferred embodiment of the present invention is illustrated and indicated generally by the numeral 200. Glazing system 200 also extends continuously about the perimeter of an associated window opening and broadly comprises glazing gasket 202 and load distributing member 204 but does not include a receiver.

Glazing gasket 202 has lite-receiving channel 206 and sealing wings 208 and 210 analogous to glazing gaskets 22 and 104. Glazing system 200 also comprises a load distributing member 204 analogous to load distributing member 106. However, it is contemplated that means for mounting glazing gasket 202 in a window opening will be provided by fastening elements 210 extending through aligned apertures 212 and 213 in load distributing member 204 and gasket 202 directly into the perimeter of the window opening to seal ribs 216 and 218 against surface 18.

It is contemplated that glazing sheet 202 will be prefabricated at a manufacturing facility, and load distributing member 204 inserted at the site of installation. Gasket 202 can then be aligned in the window opening and secured with fastening elements 210 which are tightened to insure sealing contact between sealing ribs 216 and 218 and surface 18. Finally lite 16 is installed as set forth above with respect to the earlier embodiments of the present invention.

FIGS. 8–11 show yet another preferred embodiment of the present invention wherein the receiver has a central channel for retention of the gasket spline and a pair of side channels to provide increased lateral stability for the gasket to resist rotation about its longitudinal axis under wind load. The receiver also provides laterally displaced fastening locations. This results in improved sealing, glass retention and over all stability.

Figure 8:
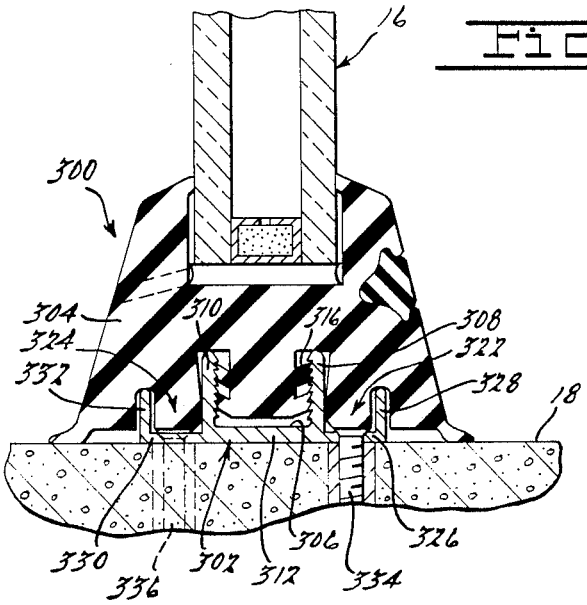
FIG. 8 is a sectional view, broken away, analogous to FIG. 3 but showing yet another alternative embodiment of the present invention.
Figure 9:
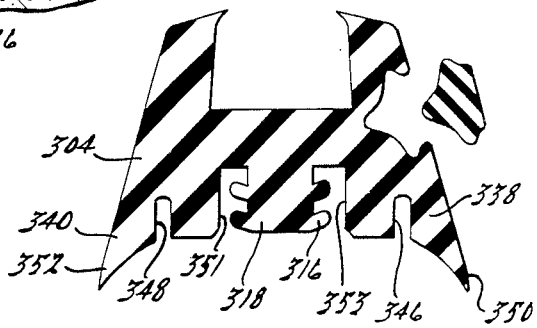
FIG. 9 is a sectional view somewhat similar to FIG. 8 but showing the glazing gasket of FIG. 8 before installation.

Now referring to FIGS. 8 and 9, a glazing system for insulated glass, for example, one inch double pane glass, is illustrated and indicated generally by the numeral 300. Glazing system 300, generally comprises a modified receiver 302 and gasket 304.

Receiver 302 has a central channel 306 defined by legs 308 and 310 and web portion 312. The inwardly facing surfaces of legs 308 and 310 have serrations which cooperate with lugs 316 of gasket 304 to retain spline 318 therein. Receiver 302 also has side channels 322 and 324. Side channel 322 is defined by leg 308, web portion 326 and by leg 328. Side channel 324 is defined by leg 310, web portion 330 and by leg 332. Legs 328 and 332 are somewhat shorter than legs 308 and 310 for ease of installation of fasteners 334 and 336 and to minimize any adverse effect on the strength of wings 338 and 340 of gasket 304. Side channels 322 and 324 allow for longitudinally spaced alternating fasteners to increase stability of receiver 302 during high wind loads. In addition, legs 328 and 332 of side channels 332 and 324 serve to prevent excessive lateral spreading of gasket 304.

Gasket 304 is similar to gasket 22 except that side wings 338 and 340 have narrow channels 346 and 348 to accommodate legs 328 and 332 of receiver 302 and have sealing vanes 350 and 352 rather than sealing ribs 74 and 76. Also, gasket 304 has narrow channels 351 and 353 to freely receive legs 308 and 310 of receiver 302.

Figure 10:
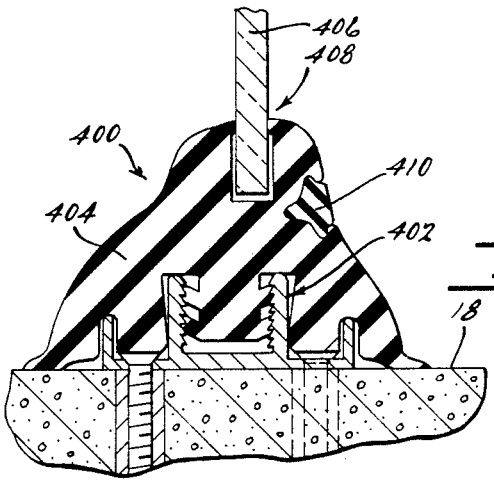
FIG. 10 is a sectional view, broken away, analogous to FIG. 3 but showing still another alternative embodiment of the present invention.
Figure 11:
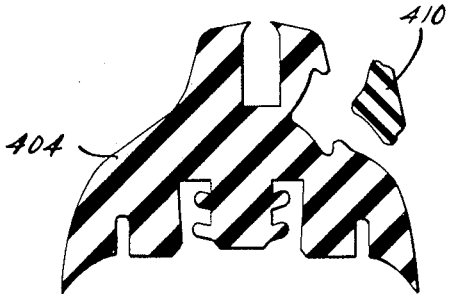
FIG. 11 is a sectional view somewhat similar to FIG. 10 but showing the glazing gasket of FIG. 10 before installation.

Now referring to FIGS. 10–11, a glazing system for single pane glass or panels is shown and indicated generally by the numeral 400. Glazing system 400 extends continuously around a window perimeter and generally comprises receiver 402 and gasket 404. Receiver 402 is analogous to receiver 302 but gasket 404 is adapted to glaze a single pane or panel 406. Thus gasket 404, while generally analogous to gasket 302, has a relatively narrow glass-receiving channel 408 which may be offset toward the lock strip as illustrated in the figures. This gasket geometry is believed to provide easier installation of lock strip 410.

While preferred embodiments of the present invention have been described herein, the present invention is subject to modification and variation within the spirit of this invention. For example, the glazing system of the invention could be used in combination with other conventional glazing systems or with multiple pane windows. Therefore, it is to be understood that the scope of the present invention is to be limited not by the foregoing examples of preferred embodiments but by the following claims.

What is claimed is:

1. A glazing system comprising:

a window opening having a perimeter surface;

a prefabricated gasket continuously extending around the perimeter surface of said window opening; said gasket having a lite-receiving channel and sealing wings abutting said perimeter surface;

nonembedded means for mounting said gasket secured on or above said perimeter surface such that said nonembedded means is covered by said gasket and said sealing wings are in sealing relationship against said window perimeter surface; and means for fastening said mounting means to said perimeter surface.

2. A glazing system as in claim 1, wherein said means for mounting said gasket comprises a receiver having a channel, said receiver attached to said perimeter surface, and a mounting spline on said gasket adapted to be retained in said receiver.

3. A glazing system as in claim 2 wherein said receiver has a serrated surface portion.

4. A glazing system as in claim 3 wherein said lite-receiving channel is defined by a pair of side walls and a web portion and one of said side walls has a groove to receive a lock strip therein.

5. A glazing system as in claim 4 wherein said wings have a plurality of sealing ribs.

6. A glazing system as in claim 1 wherein said system includes a load distributing member in said lite-receiving channel.

7. A glazing system as in claim 6 wherein said system includes a receiver and wherein both said receiver and said load distributing member are U-shaped in cross-section with a plurality of fasteners attaching one to the other.

8. A glazing system as in claim 1 wherein said system includes a load distributing member positioned in said lite-receiving channel.

9. A glazing system as in claim 8 wherein said system is secured to said perimeter surface by a plurality of fastening elements extending through said load distributing member and said gasket into said perimeter surface.

10. A glazing system as in claim 1 wherein the mounting means comprises a multi-legged channel.

11. A glazing system as in claim 1 wherein said gasket is comprised of synthetic rubber.

12. A glazing system as in claim 11 wherein said receiver has a plurality of channels and said gasket has gasket portions extending into each said channel.

13. A glazing system continuously extending around a window opening, said window opening including a perimeter surface and an interior side and an exterior side to sealably receive and retain a lite therein, said system comprising:

a nonembedded receiver adapted to be secured on or above the perimeter surface of said window opening, said receiver having a generally U-shaped channel open towards said window opening interior;

means for fastening said receiver to said perimeter surface;

an elastomeric gasket, said gasket having a lite-receiving channel open towards said window opening interior, a mounting spline and a pair of sealing wings, one of said pair of sealing wings being located on an interior side of said spline, the other of said pair being located on an exterior side of said spline;

said spline and said U-shaped channel being sized so that said spline tightly fits into said channel to retain said gasket about said perimeter surface and maintain said pair of sealing wings in sealing relationship against said perimeter surface.

14. A glazing system as in claim 13 wherein said receiver has, in cross-section, a central channel and two side channels.

15. A glazing system as in claim 14 wherein said receiver is fastened to said perimeter by fasteners extending through said side channels.

16. A glazing system as in claim 13 wherein said lite-receiving channel is, in cross-section, positioned asymmetrically with respect to said receiver.

17. A glazing system as in claim 13 wherein said gasket is comprised of synthetic rubber.

18. A glazing system as in claim 13, wherein said receiver has, in cross-section, two channels.

19. A glazing system continuously extending about a window opening in a wall having an inside and an outside, said window opening having a perimeter surface, said system comprising:

an elongated nonembedded receiver extending on or above said perimeter surface, said receiver having, in cross-section, a U-shaped portion defining a channel opening away from said perimeter surface;

means for fastening said receiver to said perimeter surface; and an elongated elastomeric gasket coextending with said receiver about said perimeter surface, said gasket having two sides, a lite-receiving channel, a spline tightly fitting in said channel of said receiver, an inside sealing wing on the side of said gasket towards said inside of said wall and an outside sealing wing on the side of said gasket towards said outside of said wall, said sealing wings in a sealing relationship against said perimeter surface.

20. A glazing system as in claim 19 wherein said receiver has three U-shaped portions defining three channels and said gasket has portions extending into each of said three channels, said sealing wings abutting against said perimeter surface.

21. A glazing system as in claim 18, wherein said two U-shaped portions defining two channels and said gasket has portions extending into each of said two channels, said sealing wings abutting against said perimeter surface.

22. A securing system comprising:

a prefabricated gasket continuously extending around a perimeter surface of an opening, said gasket having a receiving channel and sealing wings abutting said perimeter surface;

nonembedded means for mounting said gasket, said gasket mounting means adapted to be mounted on or above said perimeter surface such that said nomembedded means is covered by said gasket and said sealing wings are in a sealing relationship against said perimeter surface; and means for fastening said mounting means to said perimeter surface.

23. A securing system comprising:

a gasket adapted to be positioned on a surface about an opening, said gasket including a channel for receiving a panel member and sealing wings for sealing the gasket against the surface of the opening;

nonembedded means for securing said gasket to the surface of the opening, said means for securing positioned on or a desired distance above the surface of the opening such that said nonembedded means is covered by said gasket and said sealing wings are in a sealing relationship with the surface of the opening; and means for fastening said mounting means to the surface of the opening.

* * * * *